United States Patent [19]

Chester et al.

[11] 4,033,077

[45] July 5, 1977

[54] PORTABLE POWER ANGLE TOOL AND SWITCH MECHANISM

[75] Inventors: Nelson Sherwood Chester, Reisterstown; Thomas Cecil Laughon, Columbia; William Frank Sindelar, Towson, all of Md.

[73] Assignee: The Black and Decker Manufacturing Company, Towson, Md.

[22] Filed: Apr. 8, 1976

[21] Appl. No.: 675,119

[52] U.S. Cl. ..... 51/170 T; 200/332; 310/68 B

[51] Int. Cl.[2] ..... B24B 23/00; H01H 3/20

[58] Field of Search ..... 51/170 T, 170 PT, 170 R; 200/329, 332, 334, 335, 336; 310/71, 85, 91, 68 B

[56] References Cited

UNITED STATES PATENTS

| | | | |
|---|---|---|---|
| 3,496,680 | 2/1970 | Hutchins | 51/170 T |
| 3,585,427 | 6/1971 | Paule | 51/170 T |
| 3,775,911 | 12/1973 | Flagge | 51/170 T |
| 3,867,591 | 2/1975 | Nordeem | 200/332 |

FOREIGN PATENTS OR APPLICATIONS

| | | | |
|---|---|---|---|
| 577,198 | 5/1958 | Italy | 51/170 R |

*Primary Examiner*—Harold D. Whitehead

*Assistant Examiner*—Roscoe V. Parker

*Attorney, Agent, or Firm*—Walter Ottesen; Edward D. Murphy; Leonard Bloom

[57] ABSTRACT

A portable power angle tool includes a housing and an operating head for performing work on a workpiece. A power source supplies energy for the operating head and a switch mechanism includes a switch for interrupting the flow of energy to the operating head as well as an angle lever for actuating the switch. The angle lever is mounted on the housing and the arms of the lever extend outwardly away from the bottom of the housing. The lever can be rotated by the operator to a first position whereat one of the lever arms actuates the switch and a second position whereat the lever arms of the angle lever conjointly support the tool on the rest surface. The weight of the tool bearing down on the angle lever tends to hold the lever in its second position when the tool is set down to rest by the operator on the rest surface thereby substantially minimizing the danger that a person stepping on the tool could inadvertently turn on the tool and cause either injury to himself or damage to the workpiece to be worked. In addition, by configuring one of the lever arms as a paddle disposed close to the rest surface, additional safety is obtained because the operator will have to first obtain control over the tool before he can get his fingers beneath the paddle.

28 Claims, 6 Drawing Figures

PORTABLE POWER ANGLE TOOL AND SWITCH MECHANISM

BACKGROUND OF THE INVENTION

When portable power angle tools such as angle grinders are in the off position and not in use, it is desirable that they not be inadvertently started, for example, by a workman tripping over the tool. Further, it is preferable that the tool be firmly grasped by the operator before he can actuate the same in order to avoid injury either to himself or damage to the workpiece upon which work is to be performed.

Although the invention has general application to both air power angle tools and electric power angle tools, it is especially applicable to electric power angle grinders which, if accidentally started, can cause injury to personnel or damage to the workpiece.

SUMMARY OF THE INVENTION

Accordingly, it is an object of our invention to provide an improved portable power angle tool and switch mechanism which cannot be energized by the operator before he has firmly grasped the tool with the hand as well as providing such a portable power angle tool and switch mechanism which cannot be inadvertently energized by a person stepping on the tool when the tool is not in use and placed to rest on a rest surface.

Our invention is directed to a power angle tool which can be energized either by electrical energy or by a pressurized gas such as air under pressure. Such angle tools are suitable, for example, for grinding or sanding, or, they can be in the form of drilling devices.

The portable, power angle tool according to our invention includes an elongated housing that defines a longitudinal axis and has a size suitable to enable an operator of the tool to firmly hold the tool by grasping the tool about the housing with the hand. A bevel gear assembly is arranged at one end of the housing and extends away from the housing in a direction transverse to the longitudinal axis of the housing so as to conjointly define with the housing an angular structure. The housing and gear assembly making up the angular structure, in turn, define an enclosed angle. The angular structure is configured so that the angle tool can be manually placed to rest on a rest surface in such a manner that this enclosed angle and the rest surface conjointly describe a triangle. An energy source such as pressurized air or electric power supplies energy to the bevel gear assembly and a switch mechanism is provided which includes a switch for interrupting the flow of energy.

In the case of an air tool, the switch is in the form of a throttle valve and functions to interrupt the flow of pressurized gas to a suitable air motor, which, in turn drives the bevel gear assembly.

The portable power angle tool of our invention is especially suitable when configured as an electric power angle grinder for working a workpiece with a wook wheel such as a grinding wheel, sanding wheel, abrasion wheel or the like. In such configuration, an electric motor is mounted in the housing for driving the bevel gear assembly and here the switch is an electric switch for interrupting the flow of electric energy to the motor.

A feature of our improved portable power angle tool and switch mechanism is an angle lever for actuating the switch. We have found that it is most advantageous to mount the angle lever at a location on the housing within the region included by the above-mentioned enclosed angle defined by the angular structure. The lever has a first arm that extends outwardly from the bottom of the housing, and second arm that likewise extends away from the bottom of the housing. The arms conjointly define an angle of less than 180°. It is possible, for example, to configure the angle lever as a bell-type lever. The lever is pivotally mounted so that it is pivotable between a first position whereat the first arm actuates the switch and a second position whereat the first arm and the second arm conjointly support the structure on the rest surface in such a manner that the weight of the tool bearing down on the lever tends to hold the lever in the second position when the tool is manually placed by the operator on the rest surface.

Because the angle lever is held in its second position as described above, the power angle tool will not be turned on should the tool be inadvertently kicked or stepped down upon while not in use and disposed on a rest surface. In this way, the danger of injury to a workman or others at a construction site is substantially reduced.

It is a further feature of the invention to configure the first arm as an elongated paddle-shaped lever arm. On the other hand, the second arm is formed as stubby ridge-like projection and so causes the paddle-shaped lever arm to extend close to the rest surface when the angle lever is at its second position thereby making it difficult for the operator to pivot the angle lever to the first position until after he first has firmly grasped the tool with the hand about the housing.

In this embodiment, the elongated paddle surface of the first arm of the angle lever in the second position is close to the rest surface so that it is not possible for an operator of the tool to get his fingers underneath the lever. Instead, the operator must first firmly grasp the tool about the housing and lift it up somewhat from the rest surface in order to get his fingers underneath the paddle surface. Thus, the operator will first have the tool firmly in hand before he can rotate the lever to its first position to actuate the switch.

Still another feature and embodiment of the invention provides equipping the switch mechanism with resilient means in the form, for example, of a spring for spring loading the lever in a direction which tends to urge the lever into the second position. Also, an abutment is provided for preventing the spring from rotating the lever beyond its second position.

These and other objects and advantages of our invention will become more apparent from a consideration of the detailed desription to follow taken in conjunction with the drawing anexed hereto.

DESCRIPTION OF THE PREFERRED EMBODIMENTS OF THE INVENTION

Figure 1:
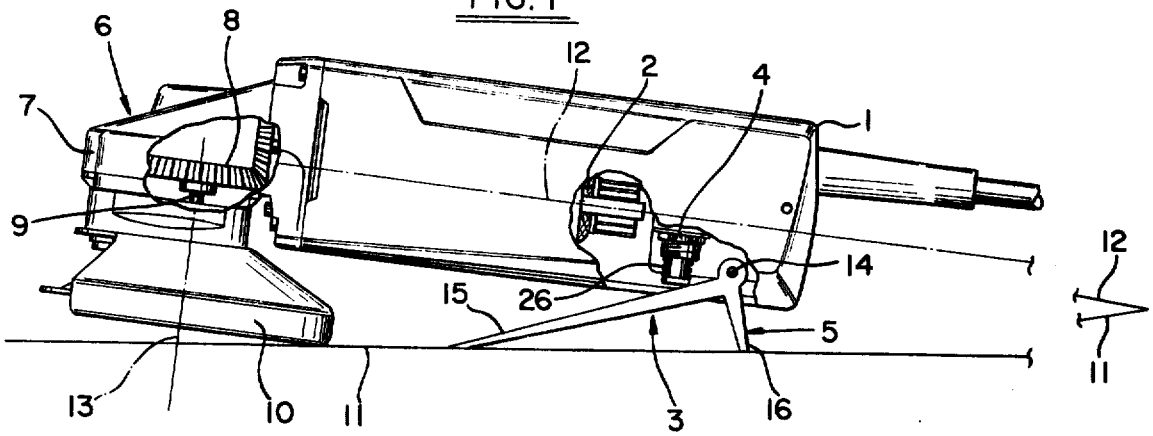
FIG. 1 is an elevation view illustrating a portable electric power angle grinder embodying the invention. Two broken out portions in this FIG. show detals of the operative assembly and switch mechanism.

Referring now more specifically to the drawing, an electric power angle grinder is shown in FIG. 1 and embodies the invention. The angle grinder includes a case housing 1 containing the drive motor 2 as well as a switch mechanism shown generally at 3. The switch mechanism 3 includes a switch 4 and an angle lever 5. At the front end of the housing 1, operating means shown generally by reference numeral 6 is provided for performing work on a workpiece. The operating means includes a gear casing 7 and a bevel gear assembly 8 for driving drive means in the form of spindle 9 as well as a wheel guard 10.

When the tool is placed manually by an operator on a rest surface 11, the angle lever 5 and the wheel guard 10 support the tool upon the surface.

The bevel gear assembly 6 and housing 1 conjointly define an angular structure which, in turn, defines an enclosed angle formed by the longitudinal axis 12 of the case housing and the spindle axis 13. As shown in the drawing, the angular structure is configured so that the angle tool can be manually placed to rest on the rest surface 11 in such a manner that the enclosed angle and the rest surface 11 conjointly describe a triangle having sides 11, 12 and 13.

Thus, from the drawing it is seen that the angle lever 5 of the switch mechanism is disposed within the region included by the enclosed angle formed by the imaginary axis lines 12 and 13. In this way, the arms of the lever 5 coact with the wheel guard 10 to support the tool on the rest surface 11.

The angle lever 5 is pivotally connected in housing 1 by means of a pivot pin 14. After lifting the tool, an operator can manually rotate angle lever 5 clockwise to a first position whereat one of the arms 15 actuates the switch 4 and then, when turning the tool off, rotates the lever 5 counterclockwise to a second position shown in FIG. 1 whereat both lever arms 15 and 16 of the angle lever 5 conjointly support the tool on the surface 11 after the operator puts the tool down to rest thereon.

Figure 2:
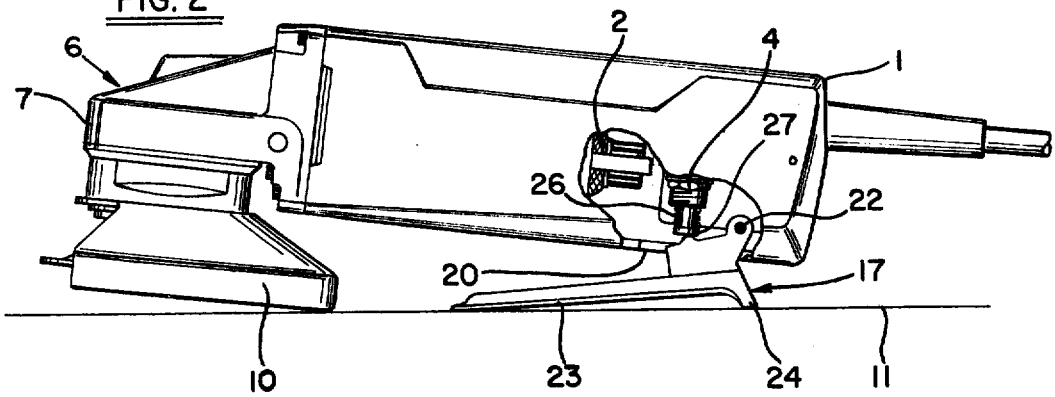
FIG. 2 is an elevation view of the portable electric power angle grinder of FIG. 1 equipped with a switching mechanism having a lever arm configured according to a preferred embodiment of the invention.

FIG. 2 shows the portable electric power angle grinder equipped with an angle lever having a somewhat modified configuration. This angle lever shown generally by reference numeral 17 is a preferred embodiment and is shown with greater clarity in the exploded view of FIG. 3.

Figure 3:
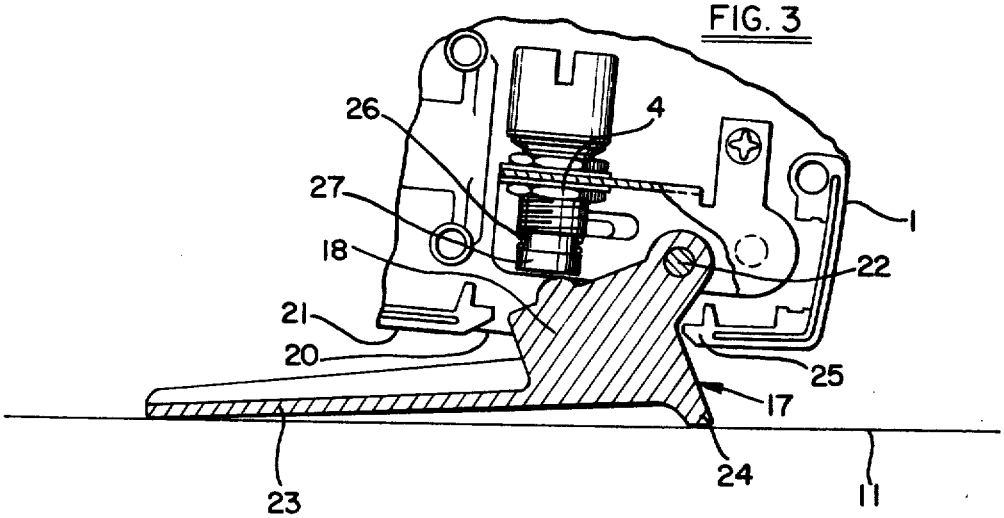
FIG. 3 is an exploded view showing details of the switch mechanism of the angle grinder of FIG. 2.

Referring now to FIG. 3, the angle lever includes a base portion 18 which is arranged inside the housing 1 and protrudes through an opening 20 formed in the bottom wall 21 of the housing 1. The base portion 18 is pivotally connected in the housing 1 by means of a pivot pin 22. First arm means in the form of first arm 23 extends from the base portion 18 in a direction outwardly away from the bottom wall 21 of the housing 1. Second arm means in the form of second arm 24 likewise extends away from the bottom wall of the housing and conjointly defines an angle of less than 180° with the first arm 23. The base portion 18 is pivotally connected inside the housing 1 so that the lever 17 is rotatable between the first position whereat the first arm 23 actuates the switch 4 and a second position whereat the first arm 23 and the second arm 24 conjointly support the angular structure on the rest surface 11 in such a manner that the weight of the tool bears down on the lever to hold the lever 17 in the second position when the tool is manually placed by the operator on the rest surface.

Figure 4:
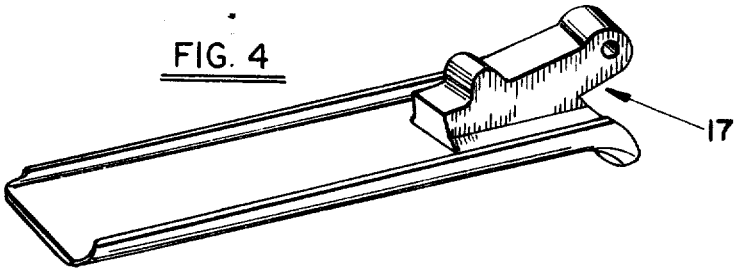
FIG. 4 is a perspective view of the angle lever shown in FIGS. 2 and 3.

As shown perspectively in FIG. 4 the first arm 23 is configured as an elongated paddle-shaped lever arm and the second arm 24 is formed as a stubby ridge-like projection which causes the paddle-shaped arm 23 to extend close to the rest surface 11 (FIG. 3) when the angle lever is in the second position. This feature contributes to the safe use of the tool because it makes it very difficlt for the operator to get his fingers underneath the paddle-shaped lever until he has first firmly grasped the tool with the hand and has lifted the housing 1 somewhat off of the surface 11. This ensures that the operator will not turn the tool on before he has a firm hold and control over the tool. In this way, a premature activation of the tool is prevented thereby minimizng the danger of physical injury to the tool user.

According to a further embodiment and feature of the invention also shown in FIG. 3, abutment means in the form of an extending projection 25 is formed at the back end of the opening 20 in the bottom wall 21 of the housing 1. The button 27 of the switch 4 is spring loaded by means of a spring 26 which urges the button 27 in the downward direction against the lever 17. The force of the spring 26 must be overcome when the lever 17 is rotated by an operator of the tool to its first position to turn the tool on. The spring 26 ensures that the switch 4 will turn the tool off when the operator releases the lever 17.

The force of the spring 26 also urges the lever against the projection 25 when the operator releases the lever 17 as well as when the tool is lifted off of the resting surface 10. The projection 25 thus serves to prevent the spring 26 from rotating the lever 17 undesirably far in the counterclockwise direction.

Figure 5:
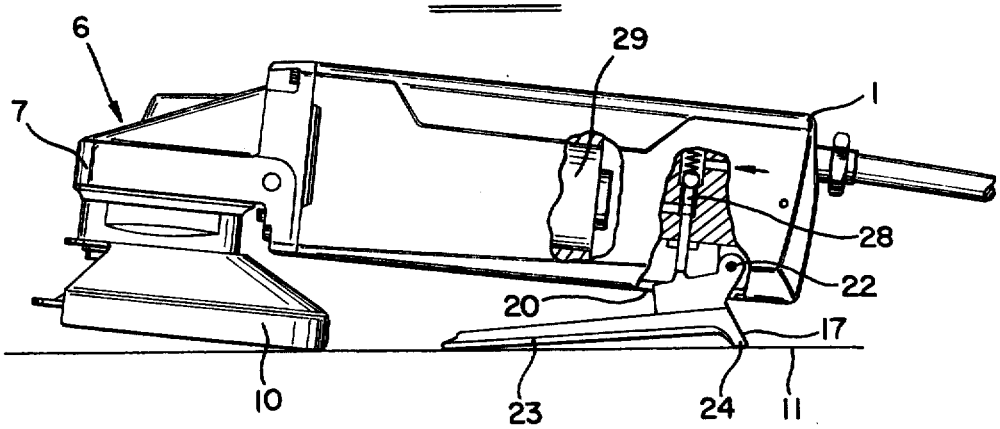
FIG. 5 is an elevation view of the portable power angle grinder according to the invention wherein the griner is constructed as an air tool having a throttle valve for interrupting the flow of pressurized gas utilized to drive the tool.

FIG. 5 illustrates a portable power angle air tool embodying the invention. Here, the switch mechanism incorporates a throttle valve 28 for interrupting the flow of air to an air motor 29. The angle lever 17 shown in FIG. 5 corresponds to the angle lever of FIGS. 3 and 4.

Figure 6:
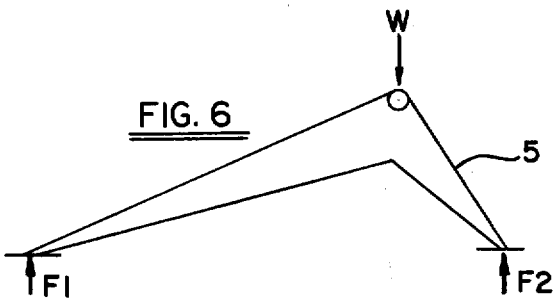
FIG. 6 is a free body diagram illustrating the lever in its position corresponding to the off condition of the tool. This FIG. shows the forces which act upon the lever to hold it in a state of static equilibrium.

FIG. 6 shows the angle lever according to FIG. 1 in a free body diagram in order to demonstrate a further safety feature of our invention. The position of the lever 5 shown in FIG. 6 corresponds to the position of the lever in its second position when the tool is at rest upon the surface 11. As shown, the lever 5 is in static equilibrium. Accordingly, if someone were to step upon the tool, the force W would increase as would the reaction forces F1 and F2. However, the switch would remain in the off position because the lever 5 is constrained to remain in the second position and cannot actuate the switch. This feature then substantially minimizes the danger that a person stepping on the tool could inadvertently turn the tool on and cause either injury to himself or damage to the workpiece to be worked.

By the foregoing, there has been disclosed an improved portable power angle tool and switch mechanism and while a preferred embodiment has been illustrated and described herein, various additions, substitutions, modifications and omissions may be made thereto without departing from the spirit of the invention.

We claim:

1. A portable, power angle tool comprising:

a housing;

operating means for performing work on a workpiece; said operating means being mounted on said housing so as to conjointly define therewith an angular structure defining an enclosed angle, said angular structure being configured so that the angle tool can be manually placed to rest on a rest surface in such a manner that said enclosed angle and the rest surface conjointly describe a triangle;

power supply means for supplying energy to said operating means; and, a switch mechanism including:

switch means for interrupting the flow of energy to said operating means; and, an angle lever mounted on said angular structure so as to be disposed inside the region included within said enclosed angle, said angle lever being pivotally mounted so as to have two arms extending from its pivot location and being pivotable between a first position whereat one of said lever arms actuates said switch means and a second position whereat said lever arms of said angle lever conjointly support said structure on the rest surface.

2. The portable, power angle tool of claim 1, said switching means comprising:

resilient means for spring loading said lever in a direction tending to urge said lever into said second position; and abutment means for preventing said resilient means from rotating said lever beyond said second position.

3. The portable, power angle tool of claim 1 wherein said tool is an air tool, said power supply means comprising means for conducting pressurized gas to said operating means for driving the same, said switch means comprising throttle valve means for interrupting the flow of pressurized gas to said operating means.

4. The portable, power angle tool of claim 1, wherein said tool is an electric tool, said power supply means including: an electric motor for driving said operating means; and, means for conducting electric energy to said electric motor; said switch means including electric switch means for interrupting the flow of electric energy to said electric motor.

5. A portable, power angle tool comprising:

an elongated housing defining a longitudinal axis and having a size suitable to enable an operator of the tool to firmly hold the tool by grasping the tool about said housing with the hand;

operating means for performing work on a workpiece; said operating means being mounted at one end of said housing and extending away therefrom in a direction transverse to said longitudinal axis so as to conjointly define with said housing an angular structure defining an enclosed angle, said angular structure being configured so that the angle tool can be manually placed to rest on a rest surface in such a manner that said enclosed angle and the rest surface conjointly describe a triangle;

power supply means for supplying energy to said operating means; and, a switch mechanism including:

switch means for interrupting the flow of energy to said operating means; and, a bell-crank type lever mounted on said housing so as to be inside the region included by said enclosed angle such that the arms of the lever extend outwardly beyond the bottom of said housing, said lever being pivotally mounted so as to be pivotable between a first position whereat said lever actuates said switch means and a second position whereat said arms of said lever conjointly support said structure on the rest surface in such a manner that the weight of the tool bearing down on said lever tends to hold said lever in said second position when manually placed by the operator on the rest surface when the tool is not in use.

6. A portable, power angle tool comprising:

an elongated housing defining a longitudinal axis and having a size suitable to enable an operator of the tool to firmly hold the tool by grasping the tool about said housing with the hand;

operating means for performing work on a workpiece; said operating means being mounted at one end of said housing and extending away therefrom in a direction transverse to said longitudinal axis so as to conjointly define with said housing an angular structure defining an enclosed angle, said angular structure being configured so that the angle tool can be manually placed to rest on a rest surface in such a manner that said enclosed angle and the rest surface conjointly describe a triangle;

power supply means for supplying energy to said operating means; and, a switch mechanism including:

switch means for interrupting the flow of energy to said operating means; and, an angle lever mounted at a location on said housing within the region included by said enclosed angle, said lever having first arm means extending outwardly from the bottom of said housing, and second arm means likewise extending away from the bottom of said housing and conjointly defining an angle of less thatn 180° with said first arm means, said lever being pivotally mounted so as to be pivotable between a first position whereat said first arm means actuates said switch means and a second position whereat said first arm means and said second arm means conjointly support said structure on the rest surface in such a manner that the weight of the tool bearing down on said lever tends to hold said lever in said second position when the tool is manually placed by the operator on the rest surface.

7. A portable, power angle tool comprising:

an elongated housing defining a longitudinal axis and having a size suitable to enable an operator of the tool to firmly hold the tool by grasping the tool about said housing with the hand;

operating means for performing work on a workpiece; said operating means being mounted at one end of said housing and extending away therefrom in a direction transverse to said longitudinal axis so as to conjointly define with said housing an angular structure defining an enclosed angle, said angular structure being configured so that the angle tool can be manually placed by the operator to rest on a rest surface in such a manner that said enclosed angle and the rest surface conjointly describe a triangle;

power supply means for supplying energy to said operating means; and, a switch mechanism including:

switch means for interrupting the flow of energy to said operating means; and, an angle lever mounted at a location on said housing within the region included by said enclosed angle, said lever having first arm means extending outwardly from the bottom of said housing, and second arm means likewise extending away from the bottom of said housing and conjointly defining an angle of less than 180° with said first arm means, said lever being pivotally mounted so as to be pivotable between a first position whereat said first arm means actuates said switch means and a second position whereat said first arm means and said second arm means conjointly support said structure on the rest surface in such a manner that the weight of the tool bearing down on said lever tends to hold said lever in said second position when the tool is manually placed by the operator on the rest surface, said first arm means being an elongated paddle-shaped lever arm; and said second arm means being formed as a stubby ridge-like projection so as to cause said paddle-shaped lever arm to extend close to the rest surface when said angle lever is at said second position thereby making it difficult for the operator to pivot said angle lever to said first position until he first has firmly grasped the tool with the hand about said housing.

J. A portable, power angle tool comprising:

an elongated housing defining a longitudinal axis and having a size suitable to enable an operator of the tool to firmly hold the tool by grasping the tool about said housing with the hand;

operating means for performing work on a workpiece; said operating means being mounted at one end of said housing and extending away therefrom in a direction transverse to said longitudinal axis so as to conjointly define with said housing an angular structure defining an enclosed angle, said angular structure being configured so that the angle tool can be manually placed to rest on a rest surface in such a manner that said enclosed angle and the rest surface conjointly describe a triangle;

power supply means for supplying energy to said operating means; and, a switch mechanism including:

switch means for interrupting the flow of energy to said operating means; and, an angle lever mounted at a location in said housing within the region included by said enclosed angle; said housing having a bottom wall with an opening formed therein; said angle lever including: a base portion arranged inside said housing and protruding out through said opening; a first arm extending from said base portion in a direction outwardly away from said bottom wall; and a second arm likewise extending away from said bottom wall of said housing and conjointly defining an angle of less than 180° with said first arm, said base portion of said lever being pivotally mounted inside said housing so as to be pivotable between a first position whereat said first arm actuates said switching means and a second position whereat said first arm and said second arm conjointly support said structure on the rest surface in such a manner that the weight of the tool bearing down on said lever tends to hold said lever in said second position when the tool is manually placed by the operator on the rest surface; said first arm being an elongated paddle-shaped lever arm; and said second arm being formed as a stubby ridge-like projection so as to cause said paddle-shaped lever arm to extend close to the rest surface when said angle lever is at said second position thereby making it difficult for the operator to pivot said angle lever to said first position until he first has firmly grasped the tool with the hand about said housing.

9. The portable, power angle tool of claim 8, said switch means comprising:

resilient means for spring loading said lever in a direction tending to urge said lever into said second position; and, abutment means for preventing said resilient means from rotating said lever beyond said second position.

10. A portable, electric power angle grinder for working a workpiece with a work wheel such as a grinding wheel, sanding wheel, abrasion wheel or the like comprising:

an elongated housing defining a longitudinal axis and having a size suitable to enable an operator of the tool to firmly hold the tool by grasping the tool about said housing with the hand;

a bevel gear assembly arranged at one end of said housing and extending away therefrom in a direction transverse to said longitudinal axis so as to conjointly define with said housing an angular structure defining an enclosed angle, said angular structure being configured so that the angle tool can be manually placed to rest on a rest surface in such a manner that said enclosed angle and the rest surface conjointly describe a triangle;

an electric motor mounted in said housing for driving said bevel gear assembly;

said bevel gear assembly including:

a gear casing mounted on said one end of said housing;

drive means for receiving the work wheel thereon; and a bevel gear for connecting said motor to said drive means;

power supply means for supplying energy to said electric motor; and, a switch mechanism including:

switch means for interrupting the flow of energy to said electric motor; and, an angle lever mounted at a location on said housing within the region included by said enclosed angle, said lever having first arm means extending outwardly from the bottom of said housing, and second arm means likewise extending away from the bottom of said housing and conjointly defining an angle of less than 180° with said first arm means, said lever being pivotally mounted so as to be pivotable between a first position whereat said first arm means actuates said switch means and a second position whereat said first arm means and said second arm means conjointly support said structure on the rest surface in such a manner that the weight of the tool bearing down on said lever tends to hold said lever in said second position when the tool is manually placed by the operator on the rest surface.

11. The portable, electric power angle grinder of claim 10, said first arm means being an elongated paddle-shaped lever arm; and said second arm means being formed as stubby ridge-like projection so as to cause said paddle-shaped lever arm to extend close to the rest surface when said angle lever is at said second position thereby making it difficult for the operator to pivot said angle lever to said first position until after he first has firmly grasped the tool with the hand about said housing.

12. The portable, electric power angle tool of claim 11, said switch means comprising:

resilient means for spring loading said lever in a direction tending to urge said lever into said second position; and abutment means for preventing said resilient means from rotating said lever beyond said second position.

13. A portable, electric power angle grinder for working a workpiece with a work wheel such as a grinding wheel, sanding wheel, abrasion wheel or the like comprising:

an elongated housing defining a longitudinal axis and having a size suitable to enable an operator of the tool to firmly hold the tool by grasping the tool about said housing with the hand;

a bevel gear assembly arranged at one end of said housing and extending away therefrom in a direction transverse to said longitudinal axis so as to conjointly define with said housing an angular structure defining an enclosed angle, said angular structure being configured so that the angle tool can be manually placed to rest on a rest surface in such a manner that said enclosed angle and the rest surface conjointly describe a triangle;

an electric motor mounted in said housing for driving the bevel gear assembly;

said bevel gear assembly including:

a gear casing mounted on said one end of said housing;

drive means for receiving the work wheel thereon; and, a bevel gear for connecting said motor to said drive means;

power supply means for supplying energy to said electric motor; and, a switch mechanism including:

switch means for interrupting the flow of energy to said electric motor; and, an angle lever mounted at a location in said housing within the region included by said enclosed angle; said housing having a bottom wall with an opening formed therein; said angle lever including: a base portion arranged inside said housing and protruding out through said opening; a first arm extending from said base portion in a direction outwardly away from said bottom wall; and a second arm likewise extending away from said bottom wall of said housing and conjointly defining an angle of less than 180° with said first arm, said base portion of said lever being pivotally mounted inside said housing so as to be pivotable between a first position whereat said first arm actuates said switch means and a second position whereat said first arm and said second arm conjointly support said structure on the rest surface in such a manner that the weight of the tool bearing down on said lever tends to hold said lever in said second position when the tool is manually placed by the operator on the rest surface, said first arm being an elongated paddle-shaped lever arm; and said second arm being formed as a stubby ridge-like projection so as to cause said paddle-shaped lever arm to extend close to the rest surface when said angle lever is at said second position thereby making it difficult for the operator to pivot said angle lever to said first position until he first has firmly grasped the tool with the hand about said housing.

14. The portable, power angle tool of claim 13, said switch means comprising:

resilient means for spring loading said lever in a direction tending to urge said lever into said second position; and, abutment means for preventing said resilient means from rotating said lever beyond said second position.

15. In a portable, power angle tool having a housing; operating means for performing work on a workpiece, the operating means being mounted in the housing so as to conjointly define therewith an angular structure defining an enclosed angle, the angular structure being configured so that the angle tool can be manually placed to rest on a rest surface in such a manner that the enclosed angle and the rest surface conjointly describe a triangle; power supply means are arranged in the housing for supplying energy to the operating means; and, a switch mechanism activating and deactivating the tool, the switch mechanism comprising:

switch means for interrupting the flow of energy to the operating means; and, an angle lever mounted on the angular structure so as to be disposed inside the region icluded within the enclosed angle, said angle lever being pivotally mounted so as to have two arms extending from its pivot location and being pivotable between a first position whereat one of said lever arms actuates said switch means and a second position whereat said lever arms of said angle lever conjointly support structure on the rest surface.

16. In a portable, power angle arm tool of claim 15 further comprising:

resilient means for spring loading said lever in a direction tending to urge said lever into said second position; and, abutment means for preventing said resilient means from rotating said lever beyond said second position.

17. In a portable, power angle air tool of claim 15 wherein the power supply means includes means for conducting pressurized gas to the operating means for driving the same, said switch means of the switching mechanism comprising: throttle valve means for interrupting the flow of pressurized gas to the operating means.

18. In a portable, power angle electric tool of claim 15 wherein the power supply means includes: an electric motor for driving said operating means; and, means for conducting electric energy to said electric motor; said switch means of the switching mechanism comprising: an electric switch means for interrupting the flow of electric energy to said electric motor.

19. In a portable, power angle tool having an elongated housing defining a longitudinal axis and having a size suitable to enable an operator of the tool to firmly hold the tool by grasping the tool about the housing with the hand; operating means for performing work on a workpiece; the operating means being mounted at one end of the housing and extending away therefrom in a direction transverse to said longitudinal axis so as to conjointly define with the housing an angular structure defining an enclosed angle, said angular structure being configured so that the angle tool can be manually placed to rest on a rest surface in such a manner that said enclosed angle and the rest surface conjointly describe a triangle; power supply means for supplying energy to the operating means; and, a switch mechanism for activating and deactivating the tool, the switch mechanism comprising:

switch means for interrupting the flow of energy to the operating means; and, a bell-crank type lever mounted on the housing so as to be inside the region included by the enclosed angle such that the arms of the lever extend outwardly beyond the bottom of the housing, said lever being pivotally mounted so as to be pivotable between a first position whereat said lever actuates said switch means and a second position whereat said arms of said lever conjointly support the angular structure on the rest surface in such a manner that the weight of the tool bearing down on said lever tends to hold said lever in said second position when manually placed by the operator on the rest surface when the tool is not in use.

20. In a portable, power angle tool having an elongated housing defining a longitudinal axis and having a size suitable to enable an operator of the tool to firmly hold the tool by grasping the tool about the housing with the hand; operating means for performing work on a workpiece; the operating means being mounted at one end of the housing and extending away therefrom in a direction transverse to said longitudinal axis so as to conjointly define with the housing an angular structure defining an enclosed angle, the angular structure being configured so that the angle tool can be manually placed to rest on a rest surface in such a manner that said enclosed angle and the rest surface conjointly describe a triangle; power supply means for supplying energy to the operating means; and, a switch mechanism for activating and deactivating the tool, the switch mechanism comprising:

switch means for interrupting the flow of energy to the operating means; and, an angle lever mounted at a location on the housing within the region included by said enclosed angle, said lever having first arm means extending outwardly from the bottom of the housing, and second arm means likewise extending away from the bottom of the housing and conjointly defining an angle of less than 180° with said first arm means, said lever being pivotally mounted so as to be pivotable between a first position whereat said first arm means actuates said switch means and a second position whereat said first arm means and said second arm means conjointly support the angular structure on the rest surface in such a manner that the weight of the tool bearing down on said lever tends to hold said lever in said second position when the tool is manually placed by the operator on the rest surface.

21. In a portable, power angle tool having an elongated housing defining a longitudinal axis and having a size suitable to enable an operator of the tool to firmly hold the tool by grasping the tool about the housing with the hand; operating means for performing work on a workpiece; the operating means being mounted at one end of the housing and extending away therefrom in a direction transverse to said longitudinal axis so as to conjointly define with the housing an angular structure defining an enclosed angle, said angular structure being configured so that the angle tool can be manually placed by the operator to rest on a rest surface in such a manner that said enclosed angle and the rest surface conjointly describe a triangle; power supply means for supplying energy to the operating means; and, a switch mechanism for activating and deactivating the tool, the switch mechanism comprising:

switch means for interrupting the flow of energy to the operating means; and, an angle lever mounted at a location on the housing within the region included by said enclosed angle, said lever having first arm means extending outwardly from the bottom of the housing, and second arm means likewise extending away from the bottom of the housing and conjointly defining an angle of less than 180° with said first arm means, said lever being pivotally mounted so as to be pivotable between a first position whereat said first arm means actuates said switch means and a second position whereat said first arm means and said second arm means conjointly support the angular structure on the rest surface in such a manner that the weight of the tool bearing down on said lever tends to hold said lever in said second position when the tool is manually placed by the operator on the rest surface, said first arm means being an elongated paddle-shaped lever arm; and said second arm means being formed as a stubby ridge-like projection so as to cause said paddle-shaped lever arm to extend close to the rest surface when said angle lever is at said second position thereby making it difficult for the operator to pivot said angle lever to said first position until he first has firmly grasped the tool with the hand about the housing.

22. In a portable, power angle tool having an elongated housing defining a longitudinal axis and having a size suitable to enable an operator of the tool to firmly hold the tool by grasping the tool about the housing with the hand; operating means for performing work on a workpiece; the operating means being mounted at one end of the housing and extending away therefrom in a direction transverse to said longitudinal axis so as to conjointly define with the housing an angular structure defining an enclosed angle, said angular structure being configured so that the angle tool can be manually placed to rest on a rest surface in such a manner that said enclosed angle and the rest surface conjointly describe a triangle; power supply means for supplying energy to said operating means; and, a switch mechanism for activating and deactivating the tool, the switch mechanism comprising:

switch means for interrupting the flow of energy to the operating means; and, an angle lever mounted at a location in the housing within the region included by said enclosed angle; the housing having a bottom wall with an opening formed therein; said angle lever including: a base portion arranged inside said housing and protruding out through said opening; a first arm extending from said base portion in a direction outwardly away from said bottom wall; and a second arm likewise extending away from said bottom wall of the housing and conjointly defining an angle of less than 180° with said first arm, said base portion of said lever being pivotally mounted inside the housing so as to be pivotable between a first position whereat said first arm actuates said switching means and a second position whereat said first arm and said second arm conjointly support the angular structure on the rest surface in such a manner that the weight of the tool bearing down on said lever tends to hold said lever in said second position when the tool is manually placed by the operator on the rest surface; said first arm being an elongated paddle-shaped lever arm; and said second arm being formed as a stubby ridge-like projection so as to cause said paddle-shaped lever arm to extend close to the rest surface when said angle lever is at said second position thereby making it difficult for the operator to pivot said angle lever to said first position until he first has firmly grasped the tool with the hand about the housing.

23. The switch mechanism of claim 22, said switch means comprising:

resilient means for spring loading said lever in a direction tending to urge said lever into said second position; and, abutment means for preventing said resilient means for rotating said lever beyond said second position.

24. In a portable, electric power angle grinder for working a workpiece with a work wheel such as a grinding wheel, sanding wheel, abrasion wheel or the like, the tool having an elongated housing defining a longitudinal axis and having a size suitable to enable an operator of the tool to firmly hold the tool by grasping the tool about the housing with the hand; a bevel grear assembly arranged at one end of the housing and extending away therefrom in a direction transverse to said longitudinal axis so as to conjointly define with the housing an angular structure defining an enclosed angle, said angular structure being configured so that the angle tool can be manually placed to rest on a rest surface in such a manner that said enclosed angle and the rest surface conjointly describe a triangle; an electric motor mounted in the housing for driving the bevel gear assembly; the bevel gear assembly including: a gear casing mounted on said one end of the housing;

drive means for receiving the work wheel thereon; and a bevel gear for connecting the motor to the drive means; power supply means for supplying energy to the electric motor; and, a switch mechanism for activating and deactivating the tool, the switch mechanism comprising:

switch means for interrupting the flow of energy to the electric motor; and, an angle lever mounted at a location on the housing within the region included by said enclosed angle, said lever having first arm means extending outwardly from the bottom of the housing, and second arm means likewise extending away from the bottom of the housing and conjointly defining an angle of less than 180° with said first arm means, said lever being pivotally mounted so as to be pivotable between a first position whereat said first arm means actuates said switch means and a second position whereat said first arm means and said second arm means conjointly support the angular structure on the rest surface in such a manner that the weight of the tool bearing down on said lever tends to hold said lever in said second position when the tool is manually placed by the operator on the rest surface.

25. The switch mechanism of claim 24, said first arms means being an elongated paddle-shaped lever arm; and said second arm means being formed as stubby ridge-like projection so as to cause said paddle-shaped lever arm to extend close to the rest surface when said angle lever is at said second position thereby making it difficult for the opeator to pivot said angle lever to said first position until after he first has firmly grasphed the tool with the hand about the housing.

26. The switch mechanism of claim 25, said switch means comprising:

resilient actuation means for spring loading said lever in a direction tending to urge said lever into said second position; and, abutment means for preventing said resilient actuation means from rotating said lever beyond said second position.

27. In a portable, electric power angle grinder for working a workpiece with a work wheel such as a grinding wheel, sanding wheel, abrasion wheel or the like, the tool having an elongated housing defining a longitudinal axis and having a size suitable to enable an operator of the tool to firmly hold the tool by grasping the tool about the housing with the hand; a bevel gear assembly arranged at one end of the housing and extending away therefrom in a direction transverse to said longitudinal axis so as to conjointly define with the housing an angular structure defining an enclosed angle, said angular structure being configured so that the angle tool can be manually placed to rest on a rest surface in such a manner that said enclosed angle and the rest surface conjointly describe a triangle; an electric motor mounted in the housing for driving the bevel gear assembly; the bevel gear assembly including: a gear casing mounted on said one end of the housing; drive means for receiving the work wheel thereon; and a bevel gear for connecting the motor to the drive means;

power supply means for supplying energy to the electric motor; and, a switch mechanism for activating and deactivating the tool, the switch mechanism comprising:

switch means for interrupting the flow of energy to the electric motor; and, an angle lever mounted at a location in the housing within the region included by said enclosed angle; the housing having a bottom wall with an opening formed therein; said angle lever including: a base portion arranged inside the housing and protruding out through said opening; a first arm extending from said base portion in a direction outwardly away from said bottom wall; and a second arm likewise extending away from said bottom wall of the housing and conjointly defining an angle of less than 180° with said first arm, said base portion of said lever being pivotally mounted inside the housing so as to be pivotable between a first position whereat said first arm actuates said switch means and a second position whereat said first arm and said second arm conjointly support the angular structure on the rest surface in such a manner that the weight of the tool bearing down on said lever tends to hold said lever in said second position when the tool is manually placed by the operator on the rest surface, said first arm being an elongated paddle-shaped lever arm; and said second arm being formed as a stubby ridge-like projection so as to cause said paddle-shaped lever arm to extend close to the rest surface when said angle lever is at said second position thereby making it difficult for the operator to pivot said angle lever to said first position until he first has firmly grasped the tool with the hand about the housing.

28. The switch mechanism of claim 27, said switch means comprising:

resilient means for spring loading said lever in a direction tending to urge said lever into said second position; and, abutment means for preventing said resilient means for rotating said lever beyond said second position.

* * * * *